US008794725B2

(12) United States Patent
Miller et al.

(10) Patent No.: US 8,794,725 B2
(45) Date of Patent: Aug. 5, 2014

(54) DIRECT ACTING VACUUM CONTROL INK SYSTEM

(75) Inventors: Cris R. Miller, Champlin, MN (US); John E. Bateson, Colleyville, TX (US); Yahua Li, Andover, MN (US)

(73) Assignee: Engage Technologies Corp., Brooklyn Park, MN (US)

( * ) Notice: Subject to any disclaimer, the term of this patent is extended or adjusted under 35 U.S.C. 154(b) by 173 days.

(21) Appl. No.: 13/344,801

(22) Filed: Jan. 6, 2012

(65) Prior Publication Data

US 2012/0176429 A1 Jul. 12, 2012

Related U.S. Application Data

(60) Provisional application No. 61/430,395, filed on Jan. 6, 2011.

(51) Int. Cl.
*B41J 29/38* (2006.01)
*B41J 2/175* (2006.01)

(52) U.S. Cl.
CPC ..... *B41J 2/175* (2013.01)
USPC ..... 347/6

(58) Field of Classification Search
None
See application file for complete search history.

(56) References Cited

U.S. PATENT DOCUMENTS

| | | | | |
|---|---|---|---|---|
| 6,183,076 | B1 * | 2/2001 | Childers et al. | 347/86 |
| 2008/0036825 | A1 | 2/2008 | Zhang | |
| 2008/0055378 | A1 * | 3/2008 | Drury et al. | 347/92 |
| 2008/0231650 | A1 * | 9/2008 | Kojima et al. | 347/17 |
| 2009/0256878 | A1 | 10/2009 | Ohnishi | |
| 2010/0039460 | A1 | 2/2010 | Delueg | |
| 2010/0073439 | A1 | 3/2010 | Wouters et al. | |
| 2010/0245411 | A1 * | 9/2010 | Kato et al. | 347/6 |

FOREIGN PATENT DOCUMENTS

| | | |
|---|---|---|
| CN | 200954713 | 10/2007 |
| JP | 2010058413 | 3/2010 |

* cited by examiner

*Primary Examiner* — Geoffrey Mruk
*Assistant Examiner* — Bradley Thies
(74) *Attorney, Agent, or Firm* — Dicke, Billig & Czaja, PLLC

(57) ABSTRACT

A piezoelectric DOD printing system including a piezoelectric-based print engine, a micro pump, an ink line, a vacuum sensor, and control circuitry. The micro pump delivers ink from a cartridge reservoir to the print engine. The ink line fluidly connects an outlet of the micro pump with an inlet of the print engine. The vacuum sensor is fluidly connected to the ink line. The control circuitry is electrically coupled to the vacuum sensor and programmed to control operation of the print engine and the micro pump. The control circuitry activates and deactivates the micro pump based upon information from the vacuum sensor.

19 Claims, 6 Drawing Sheets

Direct Acting Vacuum Control Ink System Block Diagram

DIRECT ACTING VACUUM CONTROL INK SYSTEM

CROSS-REFERENCE TO RELATED APPLICATION

This application claims priority under 35 U.S.C. §119(e)(1) to U.S. Provisional Patent Application Ser. No. 61/430,395, filed Jan. 6, 2011, entitled "Direct Acting Vacuum Control Ink System", the entire teachings of which are incorporated herein by reference.

BACKGROUND

The present disclosure relates to industrial ink jet printing systems and related methods of operation. More particularly, it relates to controlled delivery of ink to a piezoelectric print engine component of industrial ink jet printing systems.

Industrial ink jet printing systems are widely employed across many industries to generate printed indicia on a multitude of products and packaging. For example, ink jet printing systems are commonly used for printing text, bar codes, and graphics on consumer products, building materials, and packaging, all on a mass production basis. The printing systems are often in-line with the manufacturing and/or packaging process, and print real time information directly on the articles of interest. The types of information typically printed include production date, expiration date, lot and shift codes, bar codes, company graphics, product name and description, etc.

Many industrial ink jet printing systems utilize a piezoelectric drop on demand print engine ("piezoelectric DOD printing") to dispense ink for printing. In general terms, piezoelectric DOD print engines incorporate an ink-filled chamber (otherwise connected to a reservoir of ink) made all, or in part, from a piezoelectric material that is positioned behind a nozzle plate. When printing is desired, a voltage is applied to the piezoelectric material behind nozzle(s) of the nozzle plate. This voltage causes the piezoelectric material to change shape, in turn generating a pressure pulse in the ink to force a droplet of ink from the nozzle(s). Once the droplet is dispensed, the voltage is removed, the piezoelectric material returns to its original shape, and the chamber draws ink from a separate reservoir to refill. This cycle is repeated to generate successive droplets of ink.

As part of the above-described printing operations, the print engine acts like a pump by using ink and nozzle plate surface tension properties together with physical changes or pulses from the piezoelectric material. With this construction, however, there is no structural impediment to ink flow straight through the print head. To generate necessary control over ink flow to the head, then, a slight vacuum must be maintained on the ink delivered to the print engine to prevent ink from flowing through freely, while surface tension between the ink and the nozzle plate holds ink in the nozzles against the force of the vacuum. This delicate balance between ink vacuum and surface tension must be maintained for consistent printing performance in piezoelectric DOD printing.

Conventionally, one of two techniques is incorporated into the piezoelectric DOD ink jet printing system to create the necessary vacuum while delivering ink to the print engine. With a passive approach or system, gravity assists in creating the desired vacuum. A pool of ink, open to the atmosphere, is positioned slightly below the print engine in a local reservoir. An ink line is run from this local reservoir "up" to the print engine. Pressure is temporarily applied to the local reservoir to force ink through the ink line and to the print engine, displacing the air in the system ("priming" the system). Once the system is primed, the weight of the ink in the ink line pulls (via gravity) on the surface tension of the ink in the nozzles and establishes a vacuum in the print head. The height of the local reservoir relative to the print engine is adjusted to create the optimum vacuum level at the print engine during use. As ink is dispensed from the head during printing, it is replaced by ink from the local reservoir. In very basic passive systems, the ink level in the local reservoir is maintained manually, while higher end systems automate the process of replenishing the local reservoir. While gravity-based ink systems can provide the necessary vacuum/surface tension balance, for many end users these systems are not viable. In particular, components of the passive system (e.g., the local reservoir) are oftentimes in the way of the product to be printed on, or the packaging line, due to the requirement of the ink pool needing to be below the print engine.

An alternative piezoelectric DOD printing system design actively maintains a vacuum in the head through the use of a vacuum pump and control circuitry. These "active"-type systems typically use a header tank that is closed to atmosphere and positioned many inches above the print engine. An ink line leads from the header tank to the print engine. A vacuum is applied to the pool of ink in the header tank and appropriately controlled to hold the ink in the tank, and to deliver ink to the print head at the ideal vacuum level. As compared to passive system, active systems are larger, much more complex, and more expensive.

In addition to the above problems, existing industrial piezoelectric DOD printing systems often require a great deal of user oversight, for example with set-up, calibration, and maintenance. Along these lines, while some existing piezoelectric DOD print systems allow for printing in both horizontal and down "shooter" orientations (i.e., arrangement of the print engine relative to horizontal) and all angles in between, significant user efforts are required to recalibrate the system before the printing orientation can be changed.

In light of the above, a need exist for a compact piezoelectric DOD printing system with controlled delivery of ink to the print engine that overcomes the deficiencies of existing designs.

SUMMARY

One aspect provides a piezoelectric DOD printing system including a piezoelectric-based print engine, a micro pump, an ink line, a vacuum sensor, and control circuitry. The micro pump delivers ink from a cartridge reservoir to the print engine. The ink line fluidly connects an outlet of the micro pump with an inlet of the print engine. The vacuum sensor is fluidly connected to the ink line. The control circuitry is electrically coupled to the vacuum sensor and programmed to control operation of the print engine and the micro pump. The control circuitry activates and deactivates the micro pump based upon information from the vacuum sensor.

DETAILED DESCRIPTION

Figure 1:
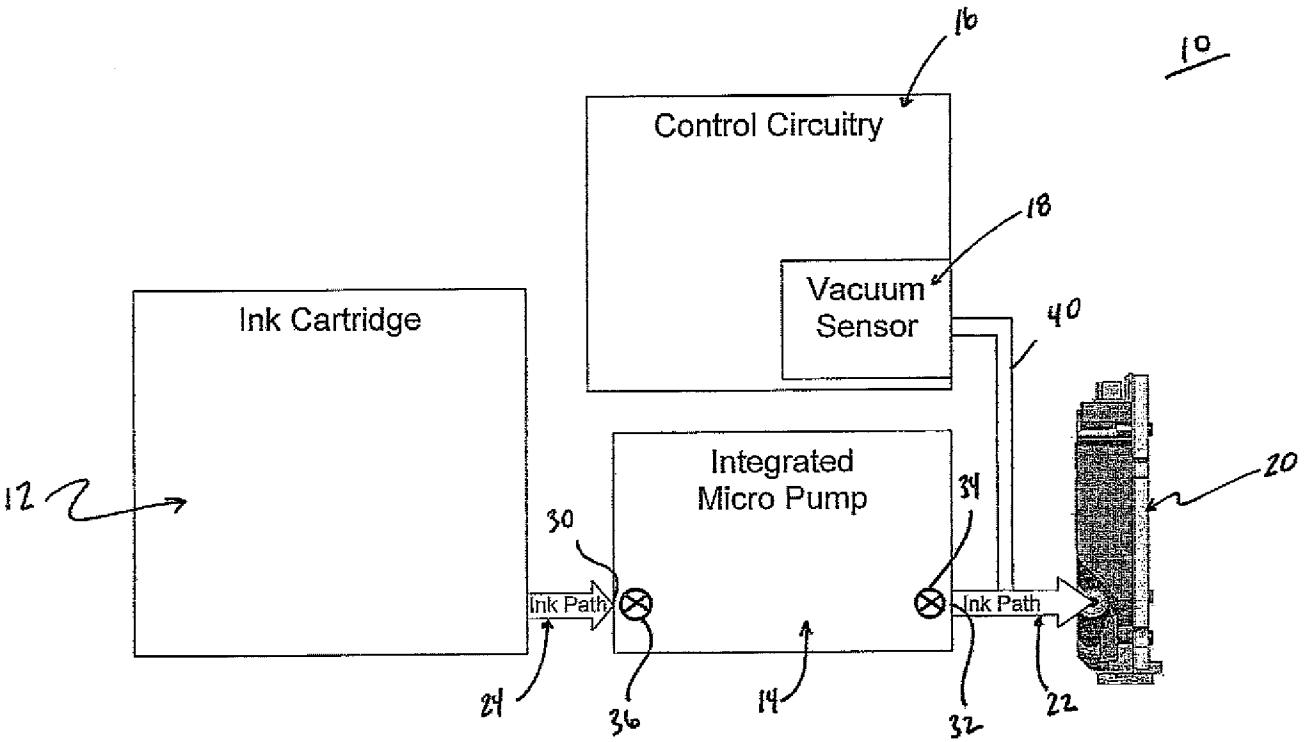
FIG. 1 is a block diagram of a piezoelectric DOD printing system in accordance with principles of the present disclosure.

One embodiment of a piezoelectric DOD printing system 10 in accordance with principles of the present disclosure is shown in FIG. 1. The printing system 10 utilizes direct acting vacuum control over the delivery of ink, and includes an ink cartridge 12, a micro pump 14, control circuitry 16, a vacuum sensor 18, and a print engine 20. As described below, the components 12-20 can assume a variety of forms. In more general terms, however, the micro pump 14 feeds ink from the cartridge 12 to the print engine 20 via a first pathway or ink line 22. The first ink line 22 is closed to flow by the micro pump 14. As the print engine 20 uses ink for printing, vacuum in the first ink line 22 increases. The vacuum sensor 18 senses this increase in negative pressure. In response, the control circuitry 16 operates to signal the micro pump 14 to begin gradually feeding a replenishment volume of ink from the cartridge 12 (via a second pathway or ink line 24) to the print engine 20. Once the vacuum level in the first ink line 22 has decreased below a set amount, operation of the micro pump 14 is stopped; subsequent delivery of additional ink occurs when the vacuum level in the first ink line 22 again exceeds a set value. With this construction, the printing system 10 effectively leverages an ability of the print engine 20 to work as a pump to create its own vacuum. This direct acting vacuum control enables the micro pump 14 to immediately respond to the demands of the print engine 20 and dynamically tune ink flow to exactly match the needs of the print engine 20. Further, because there is no orientation-dependent local ink reservoir or header tank, the system 10 will reliably feed ink when printing horizontally, downward, and any angle in between.

The cartridge 12 can assume a wide variety of forms, and is generally configured to maintain a volume of ink. In some embodiments, the cartridge 12 is formatted for direct assembly to a housing provided with the print engine 20, but in other embodiments can be physically separated from the print engine 20. The cartridge 12 can thus be an off-the-shelf item.

The micro pump 14 can similarly assume a wide variety of forms, and can be an off-the-shelf item. In some embodiments, the micro pump 14 is a precision metering pump incorporating a stepper motor and corresponding control circuitry, such as a Series 15000 linear stepper motor available from Haydon Kerk Motion Solutions of Waterbury, Conn., capable of incrementally delivering small volumes of ink at dosages on the order of 0.1 micro liters (or less). Other micro pump configurations are equally acceptable. The micro pump 14 forms or defines an inlet side or port 30 and an outlet side or port 32. The inlet side 30 is fluidly connected to the ink cartridge 12 (via second ink line 24), whereas the outlet side 32 is fluidly connected to the print engine 20. In this regard, the micro pump 14 includes one or more valves, such as check valves, including an outlet valve 34 at or fluidly adjacent the outlet port 32. The outlet valve 34 operates to fluidly isolate the first ink line 22 from the micro pump 14 during periods where the stepper motor (or other pump-related mechanism of the micro pump 14) is inactive and ink is not being delivered to the print engine 20. The outlet valve 34 can serve to check reverse ink flow when the stepper motor plunger is retracting. Thus, the outlet valve 34 assists in formation of a vacuum/negative pressure within the first ink line 22. An inlet valve 36 can also be provided at or fluidly adjacent the inlet port 30, and acts to check the ink flow from the cartridge 12. Where the valves 34, 36 are check valves, a desired cracking pressure for each valve can be selected in accordance with expected operational parameters; for example, in some embodiments, the outlet valve 34 has a cracking pressure on the order of 0.07 psi and the inlet valve 36 has a cracking pressure on the order of 1.5 psi, although other cracking pressure characteristics are also acceptable.

The control circuitry 16 can assume a variety of forms, and generally includes conventional circuitry components (e.g., printed circuit board, microprocessor, memory, circuit traces, etc.) adapted and/or programmed to automatically operate the micro pump 14 and/or the print engine 20 in a desired fashion. In addition, the control circuitry 16 is programmed or adapted to electronically interface with the vacuum sensor 18 as described below.

The vacuum sensor 18 can be any conventional vacuum sensor configured to detect or measure negative pressure, such as a sensor available from Freescale Semiconductor, Inc. of Austin, Tex., under the trade designation MPXV5004DP, and can be an off-the-shelf component. In some embodiments, the vacuum sensor 18 is electrically connected to the control circuitry 16, with information signaled from the vacuum sensor 18 being acted upon by the control circuitry 16 in a pre-programmed manner. The vacuum sensor 18 can be configured or programmed to deliver a signal to the control circuitry 16 when a negative pressure exceeding a pre-determined value is detected. For example, the vacuum sensor 18 interfaces with the control circuitry 16 as a trigger, prompting the control circuitry 16 to operate the micro pump 14 (on or off) depending upon whether the vacuum sensor 18 is signaling the control circuitry 16. Under circumstances where the negative pressure level sensed by the vacuum sensor 18 is above a pre-determined set point, the vacuum sensor 18 generates a signal to the control circuitry 16, and the control circuitry 16 initiates operation of the micro pump 14; when the sensed negative pressure falls below the pre-determined set point, the vacuum sensor 18 no longer signals the control circuitry 16, and the control circuitry 16, in response to this absence of a signal, deactivates the micro pump 14. In other embodiments, the vacuum sensor 18 continuously delivers a signal to the control circuitry 16 indicative of sensed negative pressure; the control circuitry 16, in turn, is programmed to interpret and act upon the sensed negative pressure information based upon a pre-determined set point programmed to the control circuitry 16. In yet other embodiments, the vacuum sensor 18 is directly connected to the micro pump 14 and is programmed to control operation of the micro pump 14 based upon reference to a pre-determined set point.

The vacuum sensor 18 is fluidly connected (or tapped) to the first ink line 22 by tubing 40. The tubing 40 can assume various forms, and is formed of a material chemically compatible with the ink(s) utilized by the printing system 10. In some embodiments, the tubing 40 material is air permeable, such as microporous silicone tubing available, for example, from Saint-Gobain Performance Plastics under the trade name Tygon® 3350. As a point of reference, many inks absorb air; by allowing air to pass into the lumen of the tubing 40 via the microporous construction, ink in the first ink line 22 will not progress along the tubing 40 to the vacuum sensor 18. Alternatively, the tubing 40 can be formed of air impermeable materials.

The print engine 20 can be any piezoelectric DOD print engine currently available or in the future developed. In general terms, and as will be apparent to those of ordinary skill, the print engine 20 includes a piezoelectric-based ink chamber located behind a nozzle plate. The control circuitry 16 controls delivery of energy to the chamber, causing the piezoelectric material to change shape and generate a pressure pulse in the contained ink; the pressurized ink is thus forced through the nozzle(s) of the nozzle plate in droplet form. The print engine 20 can be an off-the-shelf component, such as industrial piezoelectric DOD print engines/print heads available from Xaar PLC of Cambridge, UK.

During use, the printing system 10 operates in manners akin to known industrial piezoelectric DOD print systems, with a print head of the print engine 20 being arranged adjacent a product or packaging to which printed indicia is to be applied. The control circuitry 16 prompts operation of the print engine 20 in a necessary fashion to form the desired indicia on the product or packaging. The outlet valve 34 is normally closed such that the first ink line 22 between the micro pump 14 and the print engine 20 is fluidly isolated. Throughout the printing operations, the vacuum sensor 18 monitors or senses a vacuum or negative pressure level within the first ink line 22 via the tubing 40. As the volume of ink within the print engine chamber is depleted, the vacuum or negative pressure within the first ink line 22 will rise, with the vacuum sensor 18 continuously sensing the changing negative pressure. Once the sensed negative pressure exceeds a pre-determined value (e.g., more than 2 inches of vacuum), the vacuum sensor 18 and/or the control circuitry 16 prompts the micro pump 14 to deliver a small volume of ink from the ink cartridge 12 to the print engine 20 via the first ink line 22 (to replenish the print engine's chamber). The added volume of ink lowers the negative pressure level within the first ink line 22; when the sensed negative pressure level falls below the pre-determined value, the vacuum sensor 18 and/or the control circuitry 16 deactivates the micro pump 14, and the outlet valve 34 is closed. The process of periodically operating the micro pump 14 as a function of sensed vacuum continues throughout the printing task. Notably, the metered delivery of ink to the print engine 20 is independent of the spatial orientation of the print engine 20 (and in particular the print head). Thus, systems and methods of the present disclosure can be implemented with virtually any industrial printing task, including those that entail printing horizontally, downwardly, or any angle in between.

Figure 2:
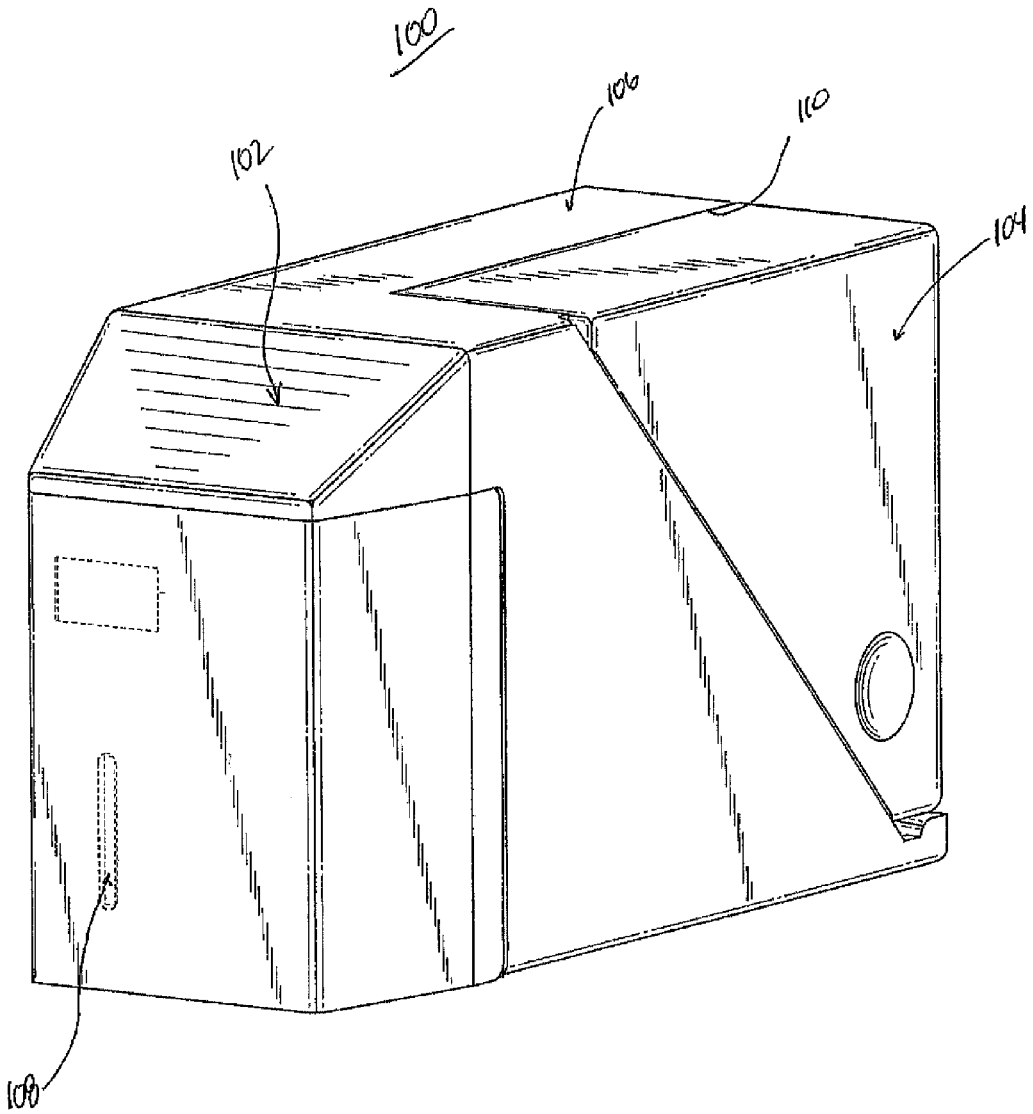
FIG. 2 is a perspective view of a piezoelectric DOD printing system in accordance with principles of the present disclosure.

One non-limiting example of a print system 100 incorporating the direct acting vacuum control features of the present disclosure is provided in FIG. 2. The system 100 includes a print engine 102 (referenced generally) and a cartridge 104. The print engine 102 is maintained within a housing 106 that otherwise locates a print head 108 at a location appropriate for printing on products or packaging. Other components of the system 100 are also maintained within the housing 106 and are not visible in the view of FIG. 2, such as a micro pump, control circuitry and a vacuum sensor. Further, the housing 106 forms a slot 110 sized and shaped to selectively receive the cartridge 104. Upon mounting of the cartridge 104 within the slot 110, an outlet port (not shown) of the cartridge 104 is fluidly connected to the micro pump (not shown) carried by the housing 106 in accordance with previous descriptions. Once the supply of ink initially provided with the cartridge 104 is depleted, the cartridge 104 is simply removed from the slot 110 and replaced with a new cartridge. As shown, the cartridge 104 and the housing 106 combine to define a highly compact footprint, and the cartridge 104 does not impede locating and orienting the print head 108 as needed for virtually any printing project.

As a point of reference, in some constructions, the cartridge 104 includes a hard outer shell (visible in the view) surrounding a flexible ink bag. The space between the outer shell and the interior bag is vented to atmosphere to allow the bag to collapse as ink is used. Alternatively, if a sealed solid cartridge is employed, an atmospheric vent can be incorporated into the cartridge to allow influx of air as ink is dispensed. While viable, this alternative approach may permit contaminants to enter the cartridge (and contaminate the contained ink) and/or allow ink to undesirably leak through the vent opening.

Various internal fluid connections between components of the system 100 can assume a wide variety of constructions. In some embodiments, fluid pathways and connections within the system 100 are configured to facilitate operation at a number of spatial orientations of the print head 108. By way of reference, in the view of FIG. 2, the housing 106 is arranged upright, locating the print head 108 for horizontal printing. Alternatively, the housing 106 can be rotated 90 degrees from the orientation of FIG. 2 (counterclockwise) to locate the print head 108 for downward printing, or any angle in between. To accommodate these multiple arrangements, fluid pathways are established that maintain an ink-free fluid connection with the vacuum sensor and the ink line between the micro pump and the print engine 102.

Figure 3A:
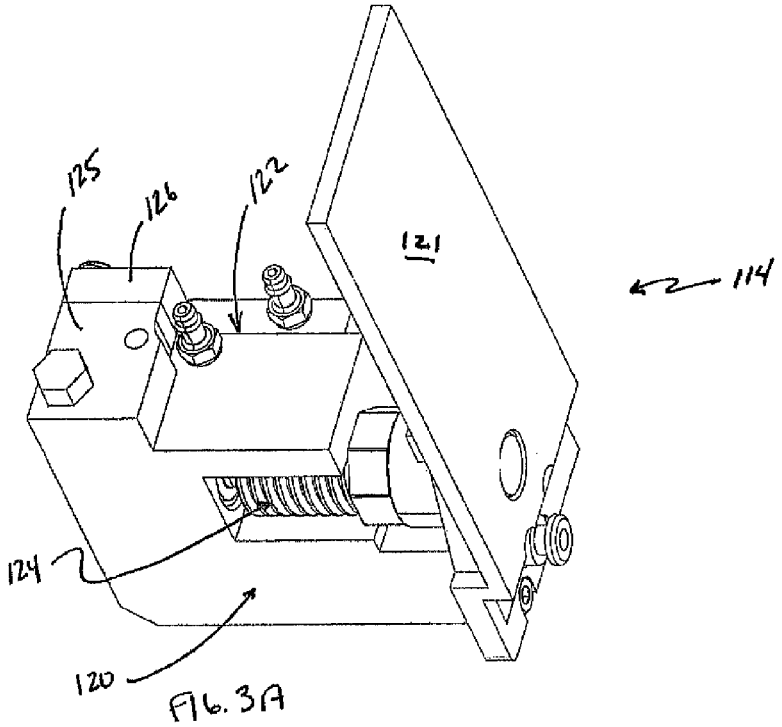
FIGS. 3A and 3B are perspective views of internal components of the printing system of FIG. 2, including a manifold assembly.
Figure 3B:
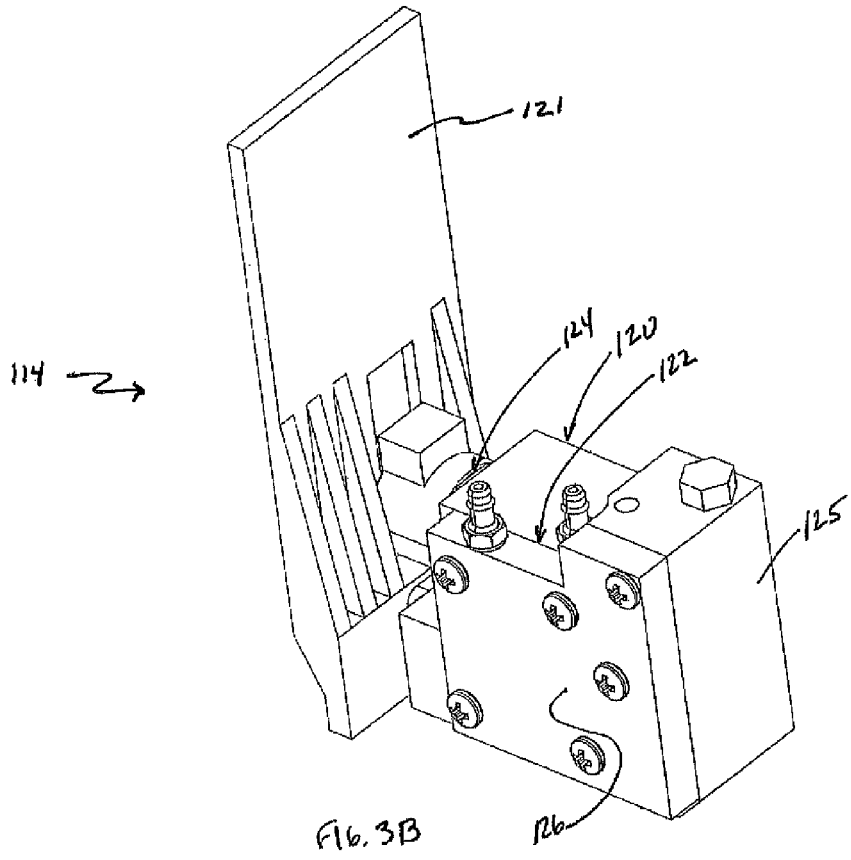
Figure 4:
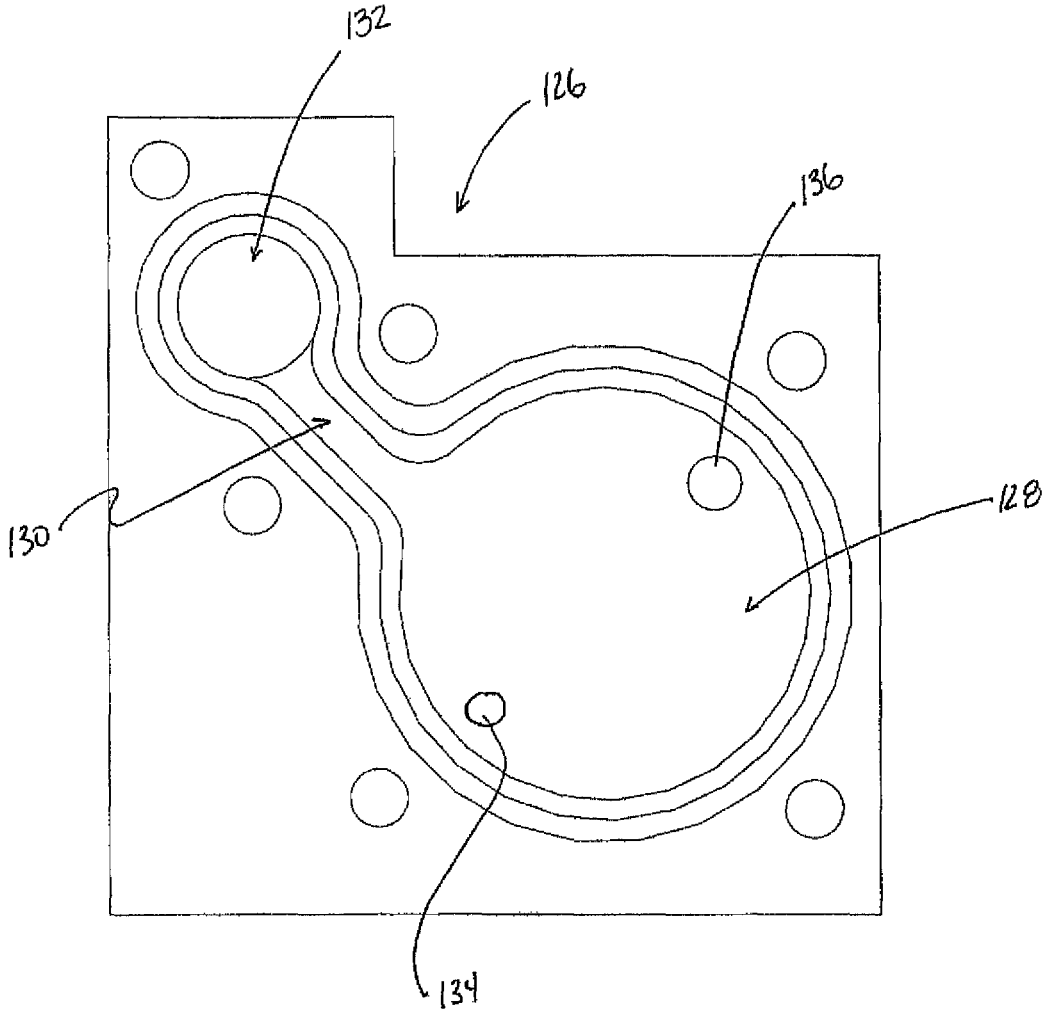
FIG. 4 is an interior side view of a plate component of the manifold assembly of FIGS. 3.

For example, FIGS. 3A and 3B illustrate portions of various components of a micro pump 114, including framework 120, a manifold assembly 122 (referenced generally), and (optionally) a cover plate 121. The framework 120 includes various features, and can retain a stepper motor 124. Various ink pathways are established within the manifold assembly 122, for example via a chamber defined between housing 125 and plate 126 components. FIG. 4 illustrates interior side of the plate 126 provided with the manifold assembly 122 (it being understood that in the view of FIGS. 3A and 3B, the interior side of the plate 126 is hidden and otherwise forms part of an interior chamber of the manifold assembly 122). A well 128 is formed into a thickness of the plate 126, along with a guide channel 130 and a port channel 132. The port channel 132 is fluidly open to the well 128 via the guide channel 130. FIG. 4 further illustrates a supply hole 134 formed through a thickness of the plate 126 within the well 128. Upon final assembly, the supply hole 134 is fluidly connected (via tubing) to the system's print engine. The port channel 132 is fluidly connected to stepper motor 124 (not shown). Finally, a vacuum tap hole 136 is formed in the plate 126 (or other structure of the manifold assembly 122) as is fluidly open to the well 128. Though not shown, the vacuum tap hole 136 is, upon final assembly, fluidly connected to the system's vacuum sensor.

With the above construction, ink from the stepper motor 124 is dispensed into the port channel 132, and flows along the guide channel 130 to the well 128. As reflected in FIG. 5A, ink 140 thus accumulates in the well 128. Once a sufficient volume of the ink 140 has been delivered, a level 142 of the ink 140 will be above the supply hole 134 as shown. At this level, then, ink from the manifold assembly 122 can flow to the print engine (not shown) via the supply hole 134. The vacuum tap hole 136 is open to the well 128, and thus the vacuum sensor (not shown) is exposed to a negative pressure generated within the well 128 as described above via the vacuum tap hole 136. However, in the orientation of FIG. 5A, the ink level 142 is below or away from the vacuum tap hole 136; thus, the opportunity for the ink 140 to undesirably enter the vacuum tap hole 136 and travel to the vacuum sensor is minimized. In one embodiment, the well 128 is circularly shaped to assist with isolating the vacuum tap hole 136 with a pocket of air above the ink level 142.

Figure 5A:
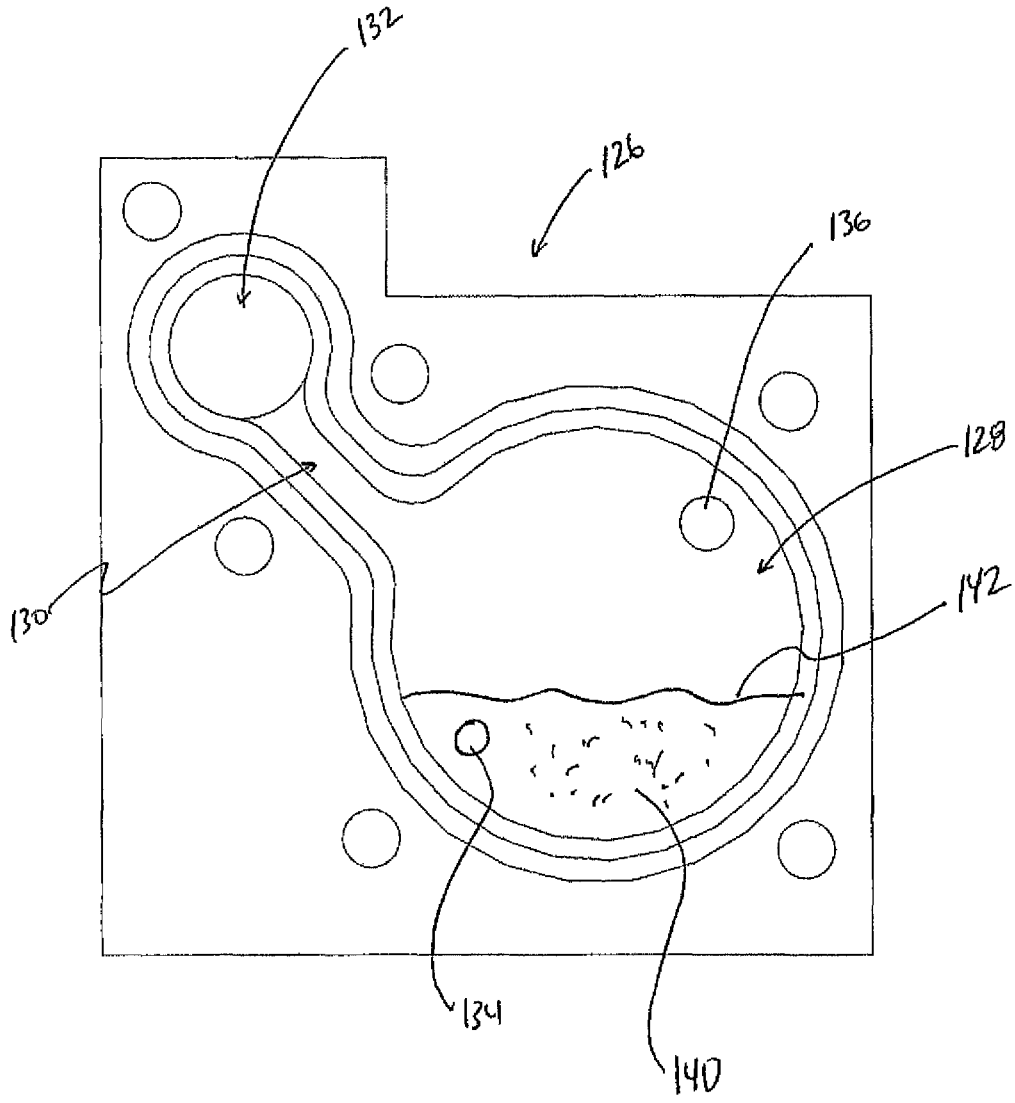
FIGS. 5A and 5B illustrate arrangement of ink within a chamber of the manifold assembly of FIG. 3 at different spatial orientations.
Figure 5B:
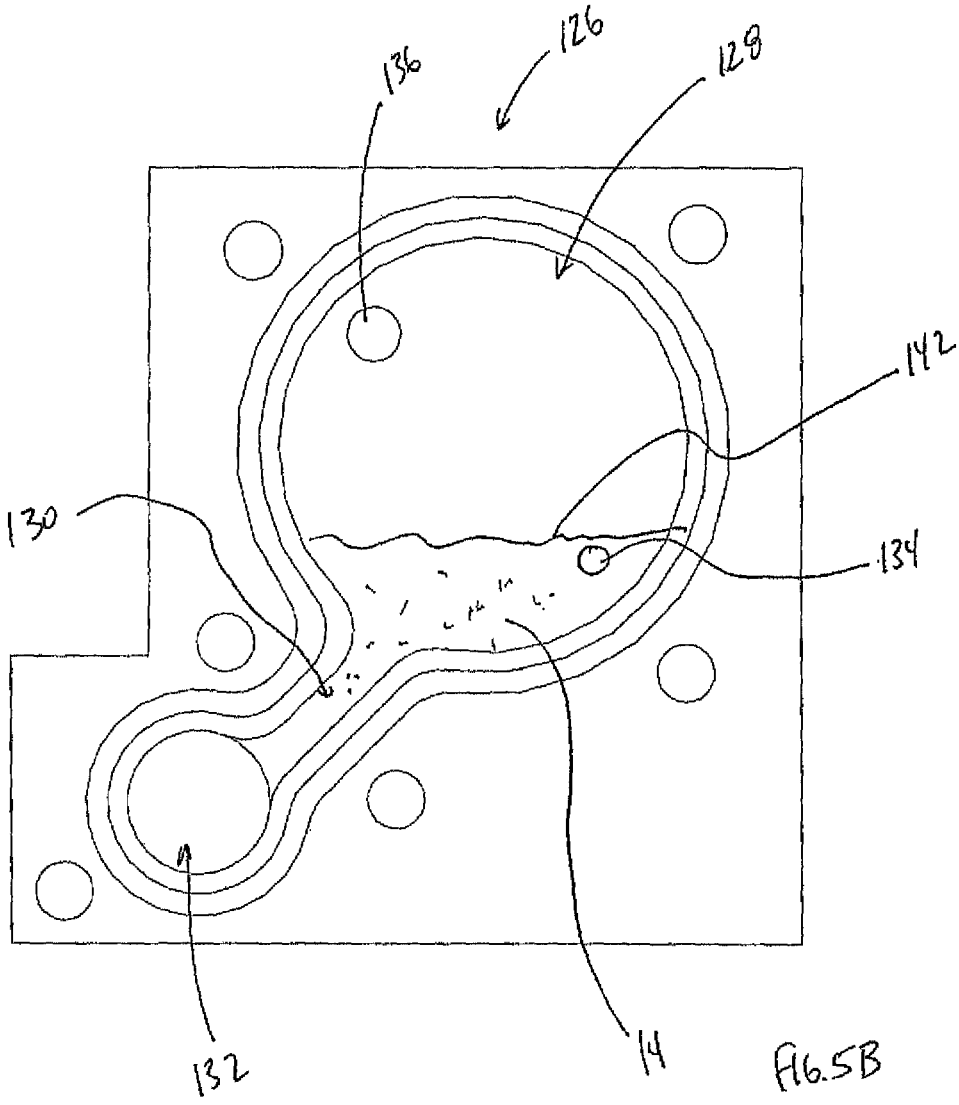

The orientation of the well 128 in FIG. 5A corresponds with the print system 100 (FIG. 2) performing a horizontal printing operation. In the view of FIG. 5B, the print system 100 has been rotated 90 degrees to perform a downward printing operation. As shown, an orientation of the well 128 has also rotated 90 degrees. When oriented for printing horizontal, downward, or any angle in between, the ink level 142 within the well 128 is effectively unchanged relative to the nozzles of the print engine (not shown). In addition, while the volume of the ink 140 within the well 128 is effectively unchanged, a relationship of the ink level 142 relative to the well 128 has been altered. Importantly, however, even in this rotated, downwardly printing orientation, the ink level 142 is still "above" the supply hole 134 but below or away from the vacuum tap hole 136. The well 128 Thus, the ink 140 will still be dispensed to the print engine as needed, and negative pressure within the well 128 will still be sensed. However, the ink 140 will not readily enter the vacuum tap hole 136 nor undesirably travel to the vacuum sensor.

The piezoelectric DOD printing systems of the present disclosure provide a marked improvement over previous designs. The direct acting vacuum control over ink delivery enables the system to immediately respond to the demands of the print engine. To this end, systems and methods of the present disclosure leverage the print engine's ability to work as a pump to create its own vacuum. Piezoelectric DOD printing systems of the present disclosure are compact and allow the ink reservoir or cartridge to be positioned even with, or above, the print engine so that the ink is out of the way for printing and at the same have simple set-up and operation. Further, systems and methods of the present disclosure readily facilitate printing in both horizontal and down shooter orientations (and all angles in between) without any need for re-calibration. In addition, systems and methods of the present disclosure may be applicable to any direct acting vacuum systems to dispense material in a regulated manner.

Although the present disclosure has been described with reference to preferred embodiments, workers skilled in the art will recognize that changes can be made in form and detail without departing from the spirit and scope of the present disclosure.

What is claimed is:

1. A piezoelectric drop-on-demand printing system comprising:

a piezoelectric-based print engine;

a micro pump configured to deliver ink from a cartridge reservoir to the print engine;

an ink line fluidly connecting an outlet of the micro pump with an inlet of the print engine;

a vacuum sensor fluidly connected to the ink line by a tubing and configured to detect negative pressure within the ink line; and a control circuitry electrically coupled to the vacuum sensor and programmed to control operation of the print engine and the micro pump;

wherein the control circuitry activates and deactivates the micro pump based upon information from the vacuum sensor, and wherein the tubing comprises a fluid pathway configured to maintain an ink-free fluid connection with the vacuum sensor and the ink line.

2. The system of claim 1, wherein the control circuitry is programmed to activate the pump when a negative pressure sensed by the vacuum sensor exceeds a pre-determined value.

3. The system of claim 2, wherein the control circuitry is programmed to deactivate the micro pump when a negative pressure sensed by the vacuum sensor falls below the pre-determined value.

4. The system of claim 1, wherein the print engine includes a print head, and further wherein the system is configured to perform printing operations with the print head spatially oriented for horizontal printing and downward printing.

5. The system of claim 1, wherein operation of the print engine in dispensing ink from a print head creates negative pressure in the ink line and sensed by the vacuum sensor such that the control circuitry operates the micro pump to dynamically tune supply of ink to the ink line as a function of demands of the print engine.

6. The system of claim 5, wherein the system is characterized by the absence of an external vacuum source.

7. The system of claim 1, wherein the micro pump includes an outlet valve configured to fluidly isolate the ink line from the micro pump when the micro pump is inactive.

8. A printing system, comprising:

a print engine;

a micro pump configured to deliver ink from a cartridge to the print engine through a first pathway;

a vacuum sensor fluidly connected to the first pathway configured to detect negative pressure within an ink line;

a control circuitry electrically coupled to the vacuum sensor and configured to operate at least one of the micro pump and the print engine; and a housing configured to maintain the print engine, the micro pump, the vacuum sensor, and the control circuitry and to receive the cartridge, wherein the first pathway is configured to maintain an ink-free fluid connection with the vacuum sensor and the ink line.

9. The system of claim 8, wherein the vacuum sensor is programmed to control operation of the micro pump based on a pre-determined set point.

10. The printing system of claim 8, wherein the vacuum sensor selectively prompts the control circuitry to operate the micro pump.

11. The system of claim 10, wherein the vacuum sensor delivers a signal to the control circuitry when a negative pressure exceeding a pre-determined value is detected by the vacuum sensor.

12. The system of claim 11, wherein the control circuitry is programmed to activate and deactivate the micro pump in response to the vacuum sensor signal.

13. The system of claim 8, wherein the vacuum sensor continuously delivers a signal to the control circuitry indicative of sensed negative pressure, and wherein the control circuitry is programmed to interpret and act upon the delivered negative pressure signal based upon a pre-determined set point programmed to the control circuitry.

14. The system of claim 8, wherein the micro pump is capable of incrementally delivering ink at dosages of 0.1 micro liters or less.

15. The system of claim 8, wherein the ink line is a second pathway configured to deliver ink from the cartridge to the print engine upon operation of the micro pump.

16. The system of claim 8, wherein the print engine includes a print head, and further wherein the system is configured to perform printing operations with the print head spatially oriented for horizontal printing and downward printing.

17. The system of claim 8, wherein the micro pump includes a manifold assembly including independent fluid connection ports to each of the print engine and the vacuum sensor.

18. The system of claim 17, wherein the manifold assembly further includes a well fluidly open to each of the fluid connection ports.

19. The system of claim 17, wherein the fluid connection port of the manifold assembly to the vacuum sensor is maintained above the fluid connection port of the manifold assembly to the print engine when a print head of the print engine is spatially oriented for either horizontal printing or downward printing.

* * * * *